US006624719B1

(12) United States Patent
Anderson et al.

(10) Patent No.: US 6,624,719 B1
(45) **Date of Patent: *Sep. 23, 2003**

(54) RECONFIGURABLE ELECTROMAGNETIC WAVEGUIDE

(75) Inventors: Ted Anderson, Brookfield, MA (US); Igor Alexeff, Oak Ridge, TN (US)

(73) Assignee: ASI Technology Corporation, Henderson, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/543,031

(22) Filed: Apr. 5, 2000

(51) Int. Cl.[7] ..... H01P 3/00
(52) U.S. Cl. ..... 333/99 PL; 343/701
(58) Field of Search ..... 333/99 PL; 393/701

(56) References Cited

U.S. PATENT DOCUMENTS

| | | | | |
|---|---|---|---|---|
| 2,641,702 A | * | 6/1953 | Cohen et al. | 343/701 |
| 2,643,297 A | * | 6/1953 | Goldstein et al. | 333/99 PL |
| 3,155,924 A | * | 11/1964 | Kaufman et al. | 33/39 PL |
| 3,404,403 A | | 10/1968 | Vallese et al. | |
| 3,634,767 A | | 1/1972 | Roeder et al. | |
| 3,719,829 A | | 3/1973 | Vaill | |
| 3,779,864 A | | 12/1973 | Kaw et al. | |
| 3,914,766 A | | 10/1975 | Moore | |
| 4,001,834 A | | 1/1977 | Smith | |
| 4,028,707 A | | 6/1977 | Young et al. | |
| 4,062,010 A | | 12/1977 | Young et al. | |
| 4,090,198 A | | 5/1978 | Canty et al. | |
| 4,347,512 A | | 8/1982 | Sweeney | |
| 4,473,736 A | | 9/1984 | Bloyet et al. | |
| 4,574,288 A | | 3/1986 | Sillard et al. | |
| 4,611,108 A | | 9/1986 | Leprince et al. | |
| 4,989,013 A | | 1/1991 | Smith, II et al. | |
| 5,175,560 A | | 12/1992 | Lucas et al. | |
| 5,546,096 A | | 8/1996 | Wada | |
| 5,594,456 A | | 1/1997 | Norris et al. | |
| 5,963,169 A | | 10/1999 | Anderson et al. | |
| 5,990,837 A | | 11/1999 | Norris et al. | |
| 6,046,705 A | | 4/2000 | Anderson | |

* cited by examiner

*Primary Examiner*—Benny Lee
(74) *Attorney, Agent, or Firm*—Thorpe North & Western, LLP

(57) ABSTRACT

The present invention is drawn toward plasma electromagnetic waveguides and plasma electromagnetic coaxial waveguides that are reconfigurable, durable, stealth, and flexible. Specifically, the present invention discloses and describes a reconfigurable electromagnetic waveguide comprised of a) an elongated non-conductive enclosure defining a propagation path for directional electromagnetic wave propagation; b) a composition contained within the enclosure capable of forming a plasma, said plasma having a skin depth along a surface within the enclosure such that the electromagnetic waves penetrate the skin depth and are primarily propagated directionally along the path; and c) an energy source to form the plasma. Optionally, an energy modifying medium to reconfigure the waveguide such that electromagnetic waves of various wavelengths may be propagated directionally along the path may be used. Similarly, these waveguides may be modified into coaxial configurations.

51 Claims, 6 Drawing Sheets

RECONFIGURABLE ELECTROMAGNETIC WAVEGUIDE

FIELD OF THE INVENTION

The present invention is drawn toward plasma electromagnetic waveguides and plasma electromagnetic coaxial waveguides that are reconfigurable, durable, stealth compatible, and flexible.

BACKGROUND OF THE INVENTION

A waveguide is generally configured such that current and voltage distributions can be represented by one or more traveling waves, usually in the same direction. In other words, the traveling wave patterns in current and voltage are generally uniform.

A waveguide can be likened unto a coaxial line having the central conductor removed. These waveguides, despite the absence of the central conductor, are still capable of carrying higher frequency electromagnetic waves. Therefore, an important use of waveguides in general is for the transmission of high frequency power, e.g., coupling a high-frequency oscillator to an antenna. Although high frequencies may be transmitted along coaxial cable, a waveguide is generally better than coaxial lines for transmitting large amounts of high frequency signal. If the goal is to transmit lower frequency electromagnetic waves, coaxial lines are generally better. However, only a maximum amount of power may be transmitted along a coaxial line due to the breakdown of the insulation (solid or gas) between the conductors. Additionally, energy is often lost in the insulating material that supports the center conductor.

Whether dealing with metal waveguides or metal coaxial lines, there are serious limitations as to what frequency of waves may be propagated. This is in part due to the material that has been traditionally used to in the construction of waveguides. For example, since metal has fixed properties, a metal waveguide is only capable of propagating very specific signals. This is likewise true to some extent with coaxial cables or lines.

Gas has been used as an alternative conductor to metal in various applications. In fact, in U.S. Pat. No. 5,594,456, a gas filled tube coupled to a voltage source for developing an electrically conductive path along a length of the tube is disclosed. The path that is created corresponds to a resonant wavelength multiple of a predetermined radio frequency. Though the emphasis of that patent is to transmit short pulse signal without trailing residual signal, the formation of a conductive path between electrodes in a gas medium could be relevant to other applications.

As such, it would be useful to provide plasma waveguides and plasma coaxial waveguides that are capable of propagating electromagnetic waves in a desired direction or along a desired path. Not only would these waveguides and coaxial waveguides be reconfigurable with respect to the range of signal that could be propagated, but these waveguides could also be designed to be more stealth, durable, and flexible than traditional metal waveguides and coaxial lines.

OBJECTS AND SUMMARY OF THE INVENTION

It is an object of the invention to provide plasma waveguides and plasma coaxial waveguides that are reconfigurable with respect to the breadth of electromagnetic waves that may be directionally propagated along a given path without changing the geometry of the enclosure.

It is another object of the invention to provide plasma waveguides and plasma coaxial waveguides that are more stealth, flexible, and/or durable than traditional waveguides.

These and other objects may be accomplished by the plasma waveguides and plasma coaxial waveguides of the present invention.

Specifically, the present invention discloses and describes an electromagnetic waveguide comprised of a) an elongated non-conductive enclosure defining a propagation path for directional electromagnetic wave propagation; b) a composition contained within the enclosure capable of forming a plasma, said plasma having a skin depth along a surface within the enclosure such that the electromagnetic waves penetrate the skin depth and are primarily propagated directionally along the path; and c) an energy source to form the plasma. Optionally, an energy modifying medium to reconfigure the waveguide such that electromagnetic waves of various wavelengths may be propagated directionally along the path may be used.

Additionally, a reconfigurable coaxial electromagnetic waveguide is disclosed which is comprised of a) a first elongated non-conductive enclosure defining a propagation path for directional electromagnetic wave propagation, said first enclosure further comprising a first open end and a second open end, said first open end and said second open end being connected by a channel, said channel being oriented along the direction of wave propagation; b) a second elongated non-conductive enclosure positioned within the channel of the first enclosure; c) a first composition contained within the first enclosure capable of forming a first plasma, said first plasma having a skin depth along a surface of the first enclosure; d) a second composition contained within the second enclosure capable of forming a second plasma, said second plasma having a skin depth along a surface of the second enclosure such that the electromagnetic waves penetrate the skin depth within the first enclosure and second enclosure and are primarily propagated directionally along the path; and e) at least one energy source to form the respective first and second plasmas. Optionally, an energy modifying medium to reconfigure the waveguide such that electromagnetic waves of various wavelengths may be propagated directionally along the path may be used.

DESCRIPTION OF THE DRAWINGS

In the accompanying drawings which illustrate embodiments of the invention.

DETAILED DESCRIPTION OF THE INVENTION

Before the present invention is disclosed and described, it is to be understood that this invention is not limited to the particular process steps and materials disclosed herein as such process steps and materials may vary to some degree. It is also to be understood that the terminology used herein is used for the purpose of describing particular embodiments only and is not intended to be limiting as the scope of the present invention will be limited only by the appended claims and equivalents thereof.

It must be noted that, as used in this specification and the appended claims, singular forms of "a, " "an, " and "the" include plural referents unless the content clearly dictates otherwise.

The word "between" when used in the context of coaxial waveguides is intended to include not only the space between two waveguide elements or enclosures, but also any skin depth that is penetrated by the electromagnetic wave being propagated.

Figure 1:
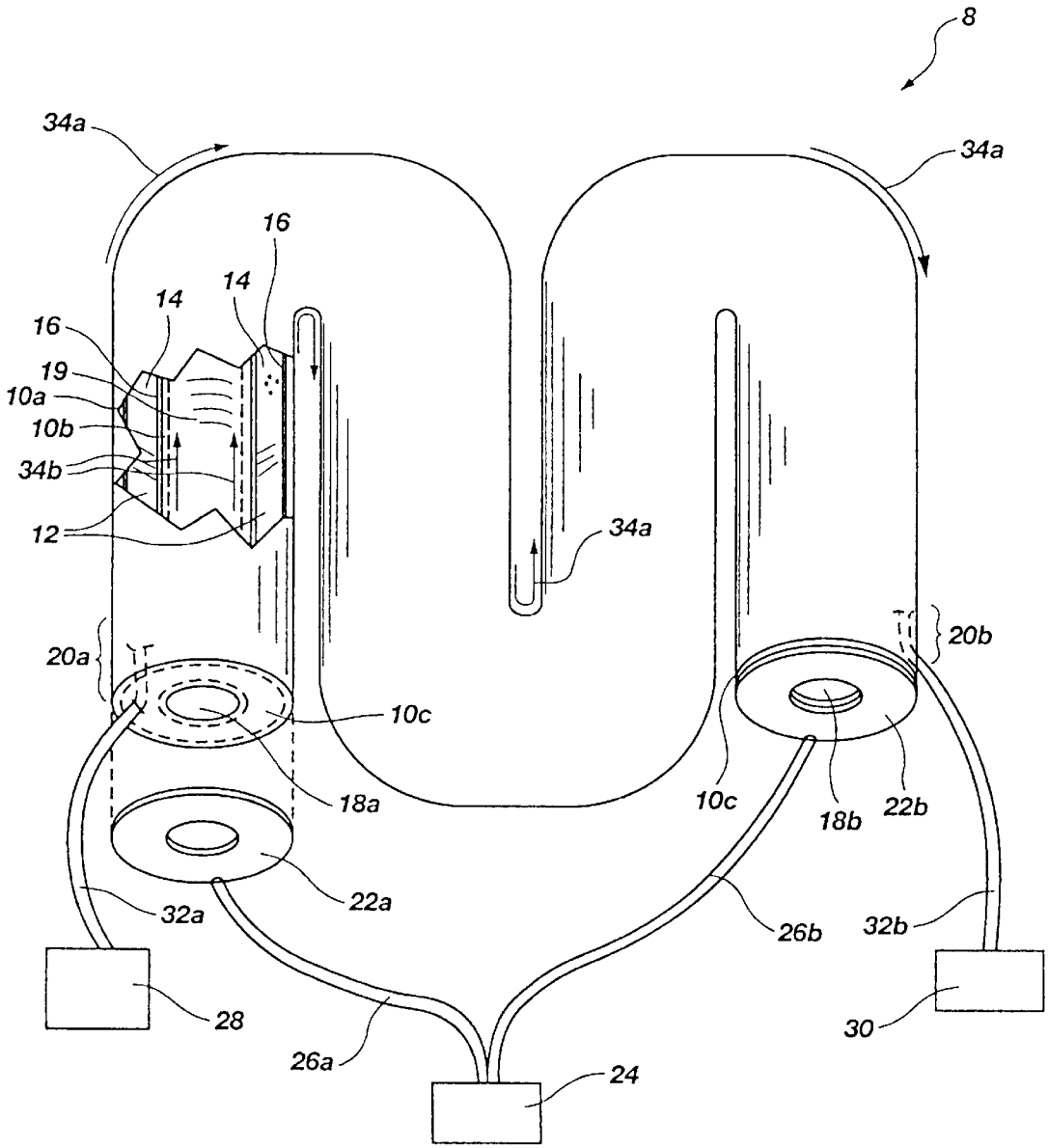
FIG. 1 is a schematic drawing of a folded annular plasma waveguide.

Referring to FIG. 1, a schematic drawing of a folded annular plasma waveguide 8 is depicted. Outer wall 10*a*, inner wall 10*b*, and end walls 10*c* surround the enclosure 12 which contains a composition 14 capable forming a plasma skin depth 16 when the composition 14 is energized. A first open end 18*a* and a second open end 18*b* are connected by a channel or hollow 19. Electromagnetic waves may either be propagated within the hollow 19 along the inner wall 10*b* and/or along the outer wall 10*a*, as long as a plasma skin depth 16 is present along the inner wall 10*b* and/or the outer wall 10*a* respectively.

The plasma waveguide 8 propagates electromagnetic waves between a first end 20*a* and a second end 20*b*. However, it would be apparent to one skilled in the art that the electromagnetic waves could be propagated from the second end 20*b* to the first end 20*a*. Alternatively, one could propagate electromagnetic waves in both directions, i.e., along the outer wall 10*a* in one direction and along the inner wall 10*b* in the other direction.

The composition 14 is energized to form a plasma skin depth 16 by a pair of electrodes 22*a*,22*b* which may be configured as shown, i.e., ring shape electrodes. The electrodes 22*a*,22*b* are energized by a power source 24. Power is carried to the electrodes 22*a*,22*b* by a pair of conductors 26*a*, 26*b*. The electrodes 22*a*,22*b* provide a voltage differential to activate the composition 14 to form a plasma skin depth 16. Though electrodes are used in this embodiment, the composition 14 could be energized to form a plasma skin depth 16 by other energizing mediums including fiber optics, high frequency signal, lasers, RF heating, electromagnetic couplers, and other mediums known by those skilled in the art.

Once the composition 14 is energized to form a plasma skin depth 16 within the enclosure 12 (along the outer wall 10*a* and/or inner wall 10*b*), electromagnetic signal may be propagated along a first path 34*a* along the outer wall 10*a* and/or a second path 34*b* along the inner wall 10*b* through the hollow 19. First, a signal is generated by a signal generator 28 which is put in electromagnetic contact with the plasma skin depth 16 by a first transport medium 32*a*. The electromagnetic wave then begins its propagation from the first end 20*a* to the second end 20*b*. The electromagnetic wave is then propagated along the outer wall 10*a* or the inner wall 10*b*, depending on how the transport medium 32*a*, the inner and outer wall 10*a*,10*b*, and/or the plasma skin depth 16 is configured. If the plasma skin depth 16 is along the outer wall 10*a*, then the electromagnetic waves will follow the first path 34*a*. If the plasma skin depth 16 is along the inner wall 10*b*, then the electromagnetic waves will follow the second path 34*b*. The electromagnetic wave penetrates the plasma skin depth 16 which acts to bind the electromagnetic wave to one or both walls 10*a*,10*b* in the direction of the first or second path 34*a*,34*b*. Once the electromagnetic wave reaches the second end 20*b*, a second transport medium 32*b* transports the signal to the signal receiver 30. "Referring now to FIG. 2, a rectangular hollow plasma waveguide 36 is depicted. A section has been cut away for illustrative purposes (shown by dotted lines). The rectangular hollow plasma waveguide 36 is comprised of outer walls 10*a*, inner walls 10*b*, and end walls 10*c*. The walls 10*a*,10*b*, 10*c* define an enclosure 12 which contains a composition 14 capable of forming a plasma skin depth (not shown) along a surface within the enclosure 12. Again, a first open end (not shown) is connected to a second open end 18*b* by a hollow 19. The waveguide 36 has a first end 20*a* and a second end 20*b*. The signal generator 28 is connected to the plasma skin depth (not shown) by a transport medium 32*a*. In this embodiment, electromagnetic waves are propagated along the inner wall 10*b* in the direction of the second path 34*b* which is through the hollow 19. Additionally, electromagnetic waves can be propagated along the first path 34*a* which coincides with wall 10*a*. The signal receiver 30 receives the electromagnetic wave signal via a second transport medium 32*b* which is also electromagnetically coupled to the plasma skin depth (not shown)."

Figure 2:
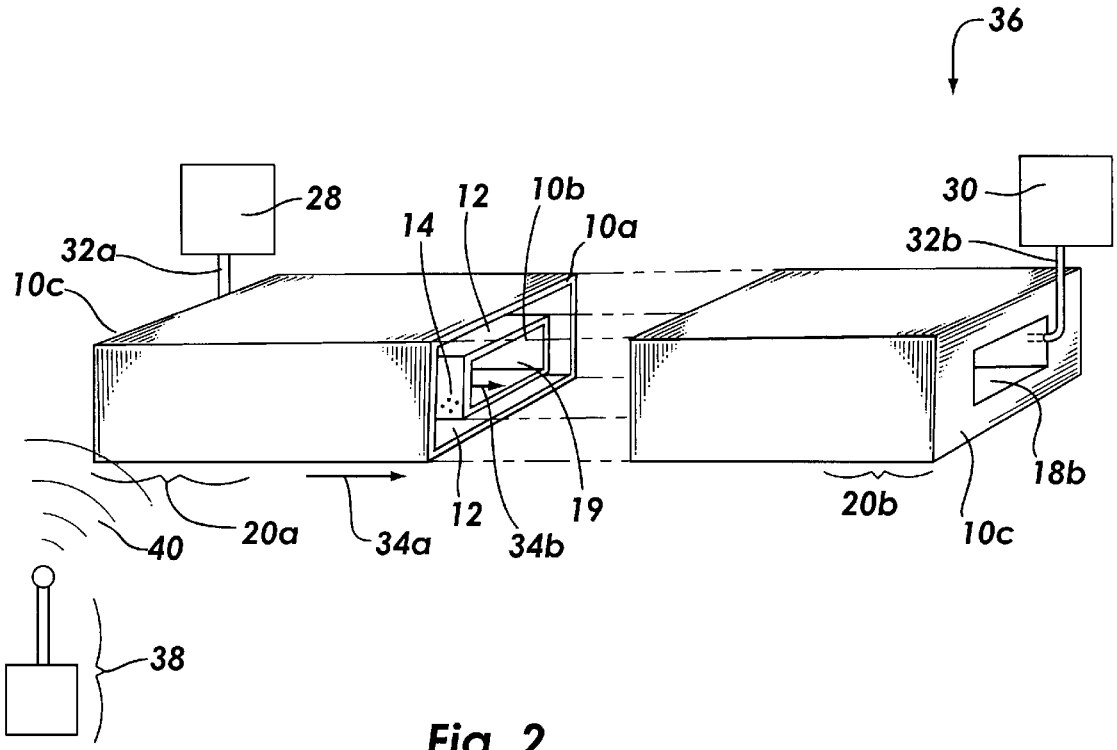
FIG. 2 is a schematic drawing of a rectangular plasma waveguide with a channel or hollow through the center in the direction of the electromagnetic wave propagation path.

As can be seen by the FIG. 2, there are no electrodes present in this embodiment for exciting the composition 14 to form a plasma skin depth. In this embodiment, high frequency signal 40 generated from a high frequency wave oscillator 38 is used to excite the composition 14 to form a plasma skin depth along a surface within the enclosure 12.

Figure 3:
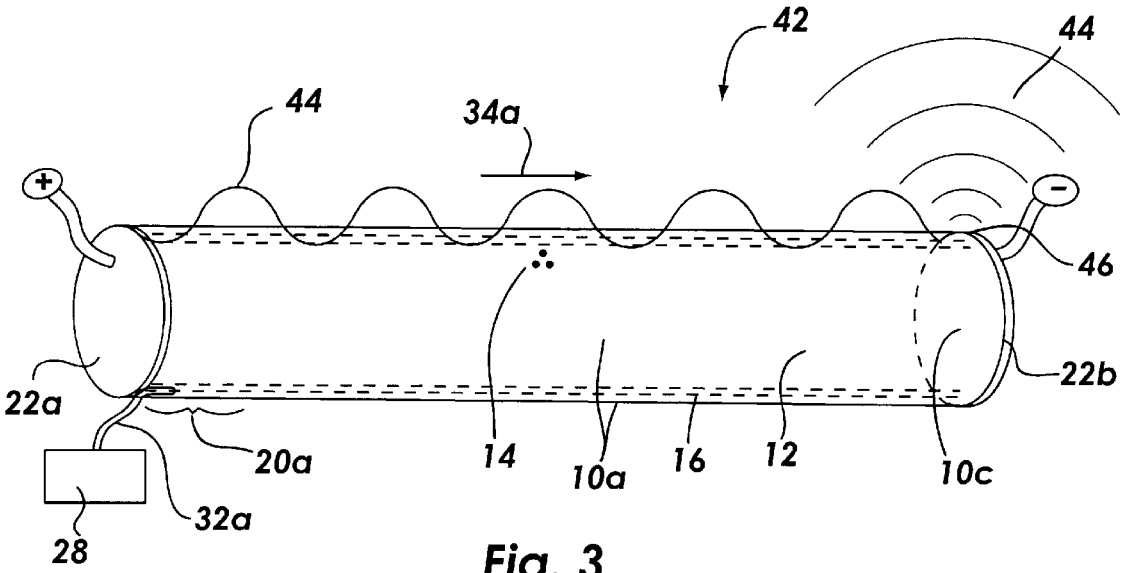
FIG. 3 is a schematic drawing of a cylindrical enclosure structure which may be used as a plasma waveguide/antenna combination where electromagnetic waves are propagated along the outermost diameter and are radiated at a discontinuity.

"Referring now to FIG. 3, a cylindrical waveguide 42 is depicted. This particular waveguide does not have a hollow through the center as was shown in FIG. 1 and FIG. 2. In this embodiment, the enclosure is defined by an outer wall 10*a* and end walls 10*c*. There is no inner wall. The plasma skin depth 16 is primarily formed along a surface within the enclosure 12 along the outer wall 10*a*. Electrodes 22*a*,22*b*, having positive (+) and negative (–) feeds, respectively, are positioned at opposing ends 20*a*,20*b* to energize the composition 14 to form a plasma skin depth 16. Electromagnetic signal 44 generated from the signal generator 28, through a transport medium 32*a*, penetrates the plasma skin depth 16 on the outer wall 10*a* and propagates along the first path 34*a*."

In this embodiment, there need not be a signal receiver because the waveguide itself can be altered to radiate the electromagnetic signal 44. This is done by introducing a discontinuity 46 in the waveguide 42. The discontinuity 46 may be introduced by altering the plasma skin depth 16, the physical structure of the enclosure 12, the impedance, and/or other apparent variables.

Figure 4:
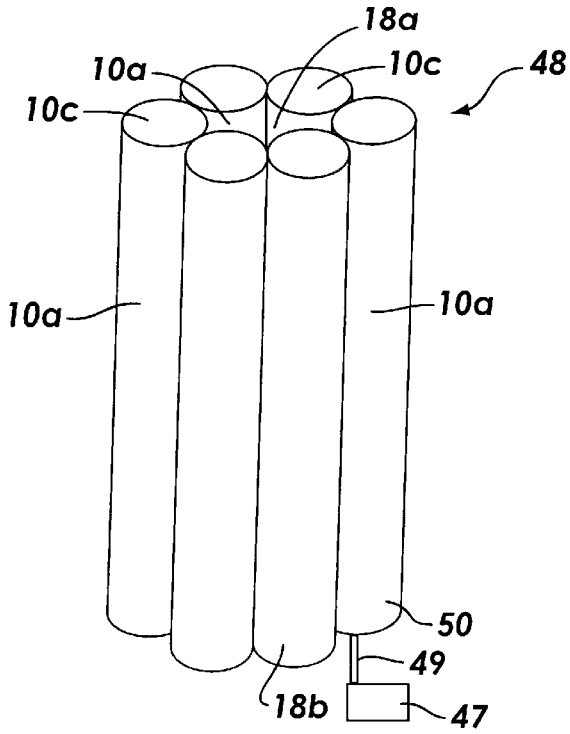
FIG. 4 is a schematic drawing of an enclosure structure having multiple chambers which may be used in a plasma waveguide.

"Referring now to FIG. 4, a multi-chambered enclosure 48 for use in a waveguide is shown. Though it is not shown electromagnetically connected to a signal generator or an energy source to form the plasma skin depth, the same principles would apply to this embodiment as applied to the other embodiments. Outer walls 10*a* and end walls 10*c* are shown. A first open end 18*a* is connected to a second open end 18*b* by a hollow (not shown). In this embodiment, the electromagnetic waves could be configured to propagate along the interior of the hollow (not shown) or along the outer most exterior surface 50. In either case, the plasma skin depth (not shown) would be within the enclosures (not shown) along the outer walls 10*a*, as there are no inner walls. Also shown is a fiber optic and/or laser source 47 as well as a transfer medium 49 which can be fiber optic line and/or a laser coupling."

Figure 5:
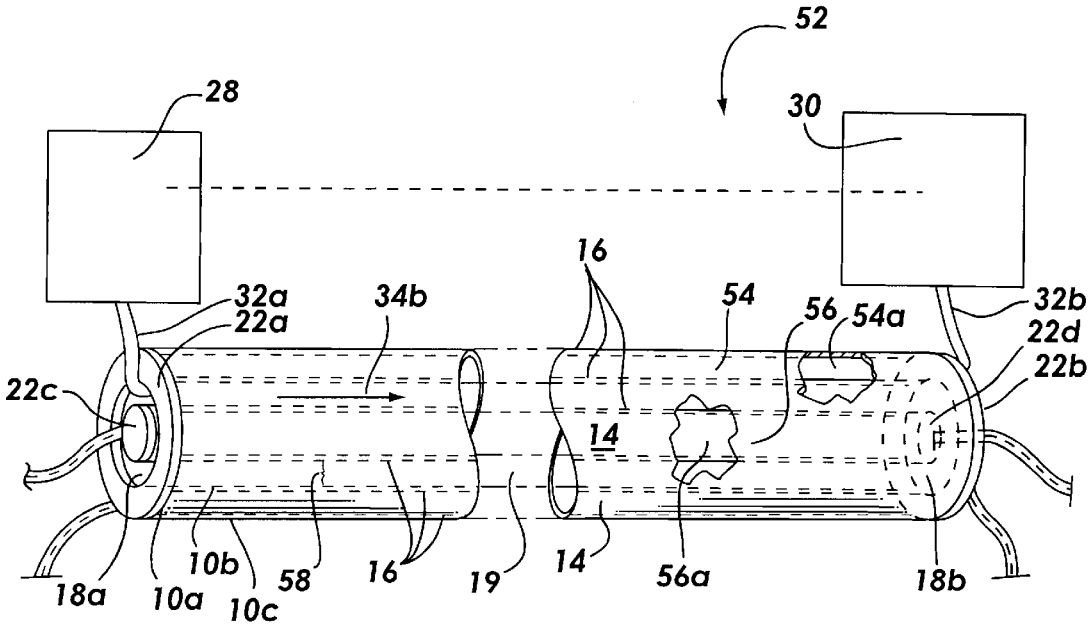
FIG. 5 is a schematic drawing of an annular coaxial plasma waveguide.

Referring now to FIG. 5, an annular coaxial waveguide 52 is shown. The annular coaxial waveguide 52 is comprised of two enclosures. A first enclosure 54 is annular in shape having an outer wall 10*a*, an inner wall 10*b*, and end walls 10*c*. A hollow 19 is positioned between a first open end 18*a* and a second open end 18*b*. A composition 14 is contained within the first enclosure 54 which is capable of forming a plasma skin depth 16 when energized.

A second enclosure 56 is positioned concentrically within the hollow 19 of the first enclosure 54. In this embodiment, the second enclosure 56 is a cylinder, though it could be any shape, e.g., annulus, rectangular, oval, etc. Further, the second enclosure 56 need not be the same length as the first enclosure 54. In this embodiment, it is preferred that the electromagnetic waves propagate in the space 58 that exists between the plasma skin depth 16 of the first enclosure 54 and the plasma skin depth 16 of the second enclosure 56. However, electromagnetic waves may propagate along the outer wall 10*a* of the first enclosure 54 as well, penetrating the plasma skin depth 16 within the outer wall 10*a*.

"The composition 14 is energized to form a plasma skin depth 16 by electrodes 22*a*, 22*b*, 22*c*, 22*d* that are powered similarly as discussed in FIG. 1. In this embodiment, the signal generator 28 produces a signal that is transported to the plasma skin depth 16 by a first transport medium 32*a*. The electromagnetic wave propagates along a path 34*b* between the plasma skin depth 16 of the first enclosure 54 and the plasma skin depth 16 of the second enclosure 56. At the end of the path 34*b*, a signal receiver 30 receives the electromagnetic wave information via a second transport medium 32*b*."

"By slightly modifying FIG. 5, another embodiment may be prepared. For example, if the first enclosure 54 were replaced with a metal structure 54*a* (such as a pipe), and the second enclosure 56 remained unchanged as a plasma chamber, then a hybrid coaxial waveguide may be formed. This hybrid type of waveguide would still be reconfigurable due to the properties of second enclosure 56. However, this waveguide would not maintain its stealth characteristics due to the metal structure. Conversely, the second enclosure 56 could be replaced by a metal structure 56*a* (such as wire) while maintaining the first enclosure 54 as a chamber for defining the plasma skin depth 16. Again, this type of coaxial waveguide would still be reconfigurable, but would not maintain its stealth characteristics."

Figure 6:
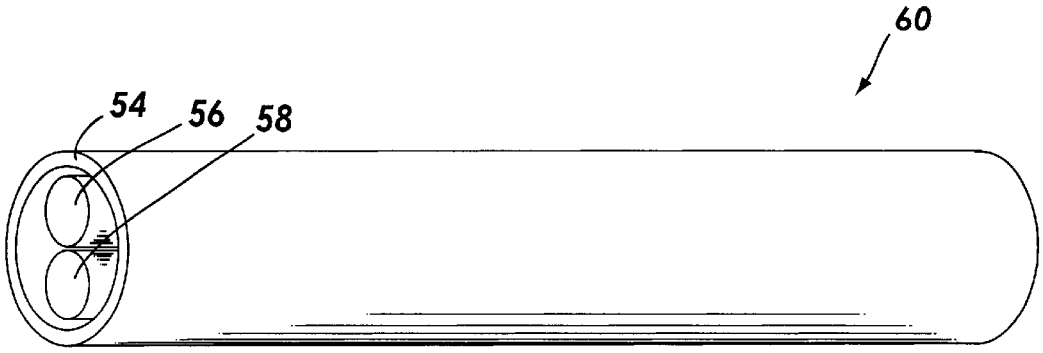
FIG. 6 is a schematic drawing of an annular coaxial enclosure having two cylindrical plasma elements within the hollow of the annular plasma enclosure for use in a modified coaxial plasma waveguide.

Referring now to FIG. 6, a triple element enclosure 60 for use as a coaxial waveguide is shown. This embodiment is similar to the embodiment of FIG. 5 with the exception that there are two cylindrical plasma enclosures 56, 58 within the annular first enclosure 54.

Figure 7:
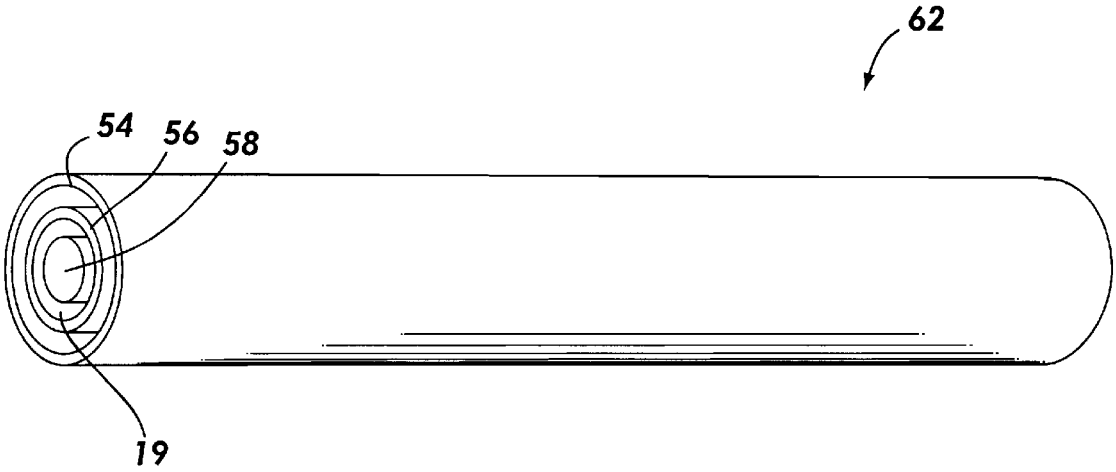
FIG. 7 is a schematic drawing of three enclosures configured concentrically for use in a modified coaxial plasma waveguide.

Referring now to FIG. 7, a concentric triple element enclosure 62 for use as a coaxial waveguide is shown. Again, this embodiment is similar to the embodiment of FIG. 5 with the exception that there are two annular enclosures 54, 56 positioned concentrically and a third element 58 positioned within the hollow 19 of the innermost annular enclosure 56. One possible application for the concentric triple element enclosure 62 would be to configure the energy source (not shown) such that electromagnetic waves would travel in one direction in one space and return in the second space. To do this, the energy source (not shown) such as electrodes could be configured at one end of the coaxial waveguide. In other words, the electrodes could be configured such that the current would flow in one direction between element 56 and element 58 and returning in the other direction between element 54 and element 56 (in each case, penetrating only the skin depth of the plasma). In one preferred configuration, element 54 could be sealed off at an end that is opposite of the electrodes (not shown) such that no radiation occurs when the propagating electromagnetic waves are transferred from between elements 56, 58 to the elements between 54, 56 (again, penetrating the respective skin depths as described previously).

Figure 8:
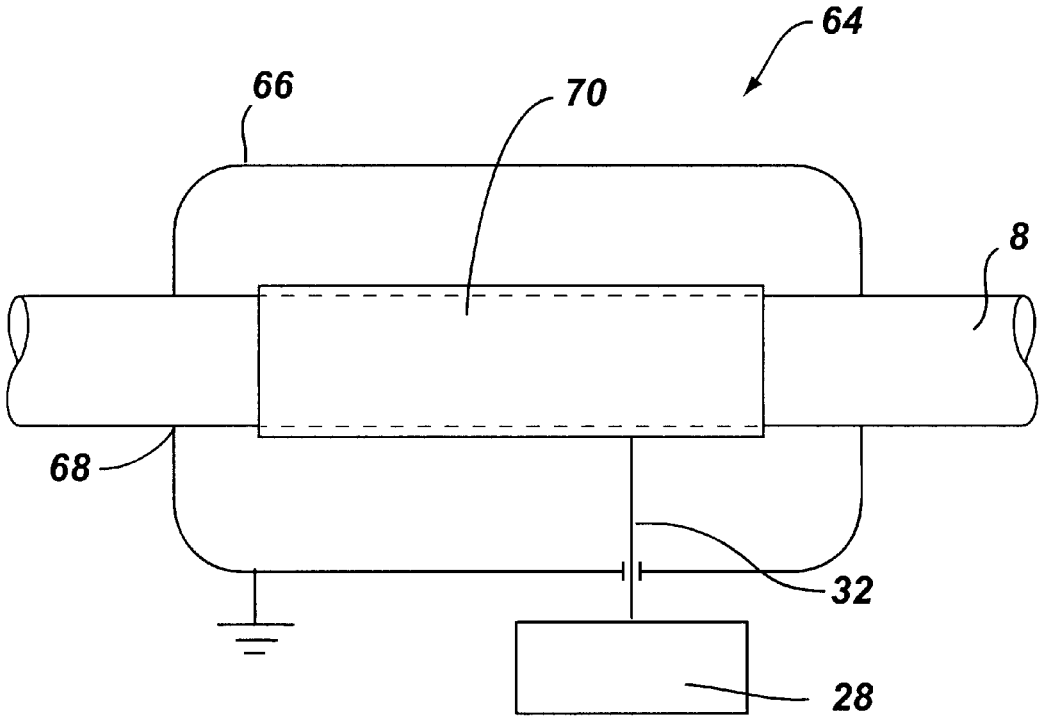
FIG. 8 is a schematic drawing of a coupler which conveys microwave power or other power directly to the composition for forming the plasma and capacitively transmitting signal to the plasma.

"Referring to FIG. 8, a schematic representation of a coupler 64 is shown which is used to both energize the composition (not shown) to form a plasma skin depth (not shown) and to transfer the desired electromagnetic wave signal to the plasma skin depth. A grounded enclosure 66 is shown that is preferably constructed from metal or other conductive material. The enclosure 66 is configured such that a plasma waveguide 8 or other plasma transmitting or receiving device is accepted through at least one opening 68 in the grounded enclosure 66, though it is preferred that the plasma device be configured such that the device also exits the enclosure 66 as shown. It is preferred that the grounded enclosure 66 surrounds a functional portion of the plasma waveguide 8 though it is not required that the grounded enclosure 66 surround the entire length of the plasma waveguide 8. A conductive sleeve 70 preferably comprised of metal and/or another conductive material is configured to surround the plasma waveguide 8 such that when an RF signal or some other frequency is applied to the sleeve 70, the dual function of altering the composition to form a plasma and capacitively coupling the signal to the plasma waveguide 8 is effectuated. The RF signal or other frequency signal can be applied to the sleeve using a signal generator 28 and a transport medium 32 as is known in the art."

Though this coupler 64 is described in conjunction with the waveguides of the present invention, it is important to note that such an coupler need not be used strictly for plasma waveguides. These couplers 64 may be used for plasma antenna elements or any other device where the dual function of forming a plasma and transmitting signal are utilized.

With the above embodiments in mind, a reconfigurable electromagnetic waveguide is disclosed and described. The waveguide is comprised generally of an elongated non-conductive enclosure defining a propagation path. The path generally follows the elongated dimension of the enclosure for directional electromagnetic wave propagation.

The preferred structure of the enclosure is comprised of a first open end and a second open end wherein the first open end and the second open end are connected by a hollow or channel in the direction of wave propagation. Most preferably, the enclosure is annular in shape. However, other cross-section configurations are also preferred such as rectangular, ellipsoidal, other functional known shapes, and enclosures having a plurality of individual chambers configured to form a hollow. The advantage of utilizing a tubular shape is that radiating electromagnetic wave loss is kept to a minimum. By propagating the electromagnetic wave through the open channel or hollow of the enclosure, electromagnetic waves are prevented from escaping into the environment as the waves can only penetrate the skin depth of the plasma. However, these waveguides may also propagate waves along the outermost surface. In fact, a cylindrically shaped waveguide without an open channel or hollow center may also act as a waveguide, though some radiation loss would be difficult to prevent.

As mentioned, the enclosure should be made from a non-conductive material, and preferably from a material or combinations of materials that are not easily degraded by the plasma. There is also some advantage to using material that is flexible. One advantage includes the ability to deform the diameter by internal or external, positive or negative pressure. Additionally, the use of a flexible material would allow for the waveguides of the present invention to be fed into hard to reach areas. For example, one may be required to insert a waveguide into an area having sharp corners. A flexible material would allow the waveguide to conform to its environment.

A composition, preferably a gas, that is capable of forming a plasma when energized should be substantially contained within the enclosure. Once formed, the plasma should have an appropriate skin depth along a surface of the enclosure. The skin depth acts to prevent electromagnetic waves from radiating from the waveguide. In other words, the electromagnetic waves penetrate the thickness of the skin depth which acts to bind the electromagnetic waves to the surface of the enclosure. Though some radiation loss may occur with the waveguides of the present invention, the electromagnetic waves will primarily adhere to the surface of the enclosure. Preferred gases may be selected from the group consisting of neon, xenon, argon, krypton, hydrogen, helium, mercury vapor, and combinations thereof, though other gasses may be used as is commonly known in the art.

An energy source is also required to convert the composition present in the enclosure to a plasma. Typically, the energy source will be in the form of electrodes, lasers, high frequency electromagnetic waves, fiber optics, RF heating, electromagnetic couplers, and/or other known energy sources. In one preferred embodiment, a pair of electrodes in electrical contact with the composition may be used to energize the composition to form a plasma skin depth. Preferably, the electrodes are an anode and a cathode positioned at opposite ends of the path. If the enclosure is annular in shape, ring electrodes are most preferred. However, the use of fiber optics or lasers are other preferred methods of energizing the composition to form the plasma, especially if the goal is to provide a waveguide that is essentially stealth to radar.

In another preferred embodiment, the composition may be both energized to form a plasma and the signal transmitted to the plasma by an electromagnetic coupler. Specifically, a coupler for forming a plasma and capacitively transferring a signal to the plasma is disclosed which comprises a) an enclosed chamber containing a composition capable of forming a plasma; b) a grounded conductive member electromagnetically coupled to the composition or plasma within the enclosed chamber; and c) a conductive sleeve for receiving signal which acts to energize the composition to form a plasma and to capacitively transmit the signal to the plasma. Though the coupler may be used with the waveguides of the present invention, they may also be used for other applications including plasma antennas and combinations of devices. Preferably, the conductive member and the conductive sleeve are comprised of metal because metal is generally an inexpensive and effective material to use. However, other conductive materials may be used. Further, though it is only required that the enclosed chamber be electromagnetically coupled to the conductive member, it is preferred that the conductive member is an enclosure configured such that the enclosed chamber may pass therethrough. Finally, exemplary signals for use with the coupler are RF signals including microwave signals.

With the waveguides of the present invention, an energy modifying medium is preferred if the waveguide is to be reconfigurable such that electromagnetic waves of various wavelengths may be propagated directionally along the path. For example, by altering the skin depth of the plasma, without changing the geometry of the enclosure, electromagnetic waves having different properties, i.e., wavelength, may be propagated down the same waveguide. Metal waveguides do not have this capability because the properties of metals are fixed. The skin depth of the plasma may be altered simply by altering the density of the plasma. Additionally, by altering the parameters of the energy source, i.e., controlling which energizing points are energized if several sources are present, controlling the voltage applied, controlling intensity applied, etc., the waveguide may be reconfigured.

Alternatively, the energy modifying medium may be the addition of composition material, e.g., neutral gas and/or plasma gas, pumped into the chamber of a flexible enclosure, thereby causing the enclosure to deform. This would change the physical shape of the waveguide allowing for different electromagnetic waves to be propagated along the path. Similarly, gas could be removed to deform the diameter of the waveguide as well.

If deformation of the chamber is not desired, then changing the pressure of the composition material without deforming the structure would alter the properties of the plasma as well. For example, by decreasing the pressure of the composition within the enclosed chamber, ionization within the chamber may increase. Conversely, by increasing the pressure of the composition, ionization may decrease. These and other modifying mediums or mechanisms apparent to those skilled in the art may be used to reconfigure the waveguides and coaxial waveguides of the present invention.

If one desires to convert the waveguide to an antenna, this may be accomplished by introducing a discontinuity in the waveguide such that the electromagnetic waves are radiated directionally. This would preferably occur with waveguides having external wave propagation, i.e, waves propagating along the most exterior surface of the enclosure. The discontinuity may be introduced in several different forms including a physical aberration, a sudden change in impedance, and/or a change in the skin depth.

The waveguides of the present invention are generally electromagnetically connected to a signal generator. This is done by putting the electromagnetic waves generated by the signal generator into contact with the skin depth of the plasma for directional wave propagation along the path. Additionally, if the waveguide is not also acting as the antenna element as describe previously, a signal receiver is preferably connected to the skin depth of the plasma to receive the electromagnetic waves generated by the signal generator and propagated by the waveguide. The signal generator and the signal receiver are generally at opposite ends of the enclosure along the direction of electromagnetic wave propagation.

The waveguides previously described may be modified to form reconfigurable coaxial electromagnetic waveguides as well. These coaxial waveguides are further comprised of a second elongated non-conductive enclosure. However, the first enclosure (or outermost enclosure) must further comprise a first open end and a second open end wherein the first open end and the second open end are connected by a channel or hollow along the direction of wave propagation. The second elongated non-conductive enclosure is positioned within the channel of the first enclosure. Each of these enclosures contain a composition capable of forming a plasma skin depth along a surface of each enclosure. However, the composition within each of the two enclosures may be a different composition, or may be the same composition. When each composition forms a skin depth of plasma, the electromagnetic waves may be primarily propagated directionally along the path such that the electromagnetic waves are confined between the skin depth of the first enclosure and the skin depth of the second enclosure. Again, an energy source to form the plasma is required. Optionally, an energy modifying medium to reconfigure the waveguide such that electromagnetic waves of various wavelengths may be propagated directionally along the path is preferred.

An alternative embodiment for coaxial waveguides requires that only one of the two elements be a plasma containing enclosure. For example, the inner element may be a metal conducting element and the outer element may be the plasma enclosure. Alternatively, the outer element may be a metal conducting element and the inner element may be the plasma enclosure. In either case, it is preferred that these elements are concentrically configured. However, as long as one element is oriented within the hollow of the other element, i.e., coaxially configured, such configurations provide the reconfigurable properties of the coaxial waveguides of the present invention. Though the metal/plasma combination waveguides are reconfigurable, due to the presence of the metal element, they would not be stealth to radar.

There are several advantages to using plasma waveguides and plasma coaxial waveguides over conventional waveguides. First, as discussed, plasma waveguides are reconfigurable. In other words, different types of electromagnetic waves may be propagated along these waveguides without a change in the enclosure geometry. Second, plasma waveguides are much more stealth than conventional waveguides. When the waveguide is not propagating, it is invisible to radar. In other words, if the plasma density is decreased enough, or completely depleted, these plasma waveguides become stealth. Additionally, these waveguides may easily be designed to be lightweight, flexible, and highly corrosion resistant.

Regarding the advantage of reconfigurability, the electromagnetic waves are capable of traveling in variable skin depths which depends on the plasma density. When the skin depth is altered by modifying the density of the plasma, the electromagnetic wave that the waveguide is capable of carrying is changed. Thus, by altering the density of the plasma, the waveguide may be reconfigured without altering the physical geometry of the dielectric or non-conductive tubing or other enclosure. Specifically, by increasing the plasma density or ionization, the plasma skin depth is decreased. Conversely, by decreasing the plasma density, the plasma skin depth is increased. Thus, the waveguide may be tuned to match the type of wave that one desires to be propagated. With metal waveguides, the equivalent of the plasma skin depth is fixed and cannot be altered.

The main purpose of these waveguides is to transport waves from one point to the next. At the terminal location, the electromagnetic waves are preferably radiated or sent to a signal receiver. During propagation, the wave will not penetrate the enclosure beyond the skin depth of the plasma, nor will the wave substantially radiate outwardly, as long as there is no discontinuity. This is because the phase speed of the wave is less than the speed of light, preventing any significant radiation. Once the traveling wave hits a sufficient discontinuity, the traveling wave may radiate directionally.

While the invention has been described with reference to certain preferred embodiments, those skilled in the art will appreciate that various modifications, changes, omissions, and substitutions can be made without departing from the spirit of the invention. It is intended, therefore, that the invention be limited only by the scope of the following claims and equivalents thereof.

We claim:

1. A plasma electromagnetic waveguide comprising:

a) an elongated non-conductive enclosure defining a propagation path for directional electromagnetic wave propagation, wherein a cross-section of the enclosure is a rectangular shape;

b) a composition contained within the enclosure capable of forming a plasma, said plasma when formed having a skin depth along a surface within the enclosure such that the electromagnetic waves penetrate the skin depth and are primarily propagated directionally along the path, and wherein said plasma provides substantially a sole medium of the electromagnetic wave propagation; and c) an energy source for energizing the composition to form the plasma.

2. A reconfigurable plasma coaxial electromagnetic waveguide comprising:

a) a first elongated non-conductive enclosure defining a propagation path for directional electromagnetic wave propagation, said first enclosure further comprising a first open end and a second open end, said first open end and said second open end being connected by a channel, said channel being configured along the direction of wave propagation;

b) a second elongated non-conductive enclosure positioned within the channel of the first enclosure;

c) a first composition contained within the first enclosure capable of forming a first plasma, said first plasma when formed having a skin depth along a surface of the first enclosure;

d) a second composition contained within the second enclosure capable of forming a second plasma, said second plasma when formed having a skin depth along a surface of the second enclosure such that the electromagnetic waves penetrate the skin depth within the first enclosure and second enclosure and are primarily propagated directionally along the path;

e) means for energizing the respective first and second compositions to form the respective first and second plasma skin depths; and f) means for reconfiguring the waveguide such that electromagnetic waves of various wavelengths may be propagated directionally along the path.

3. A reconfigurable coaxial electromagnetic waveguide, comprising:

a) an elongated non-conductive enclosure defining a propagation path for directional electromagnetic wave propagation, said non-conductive enclosure further comprising a first open end and a second open end, said first open end and said second open end being connected by a channel, said channel being oriented along the direction of wave propagation;

b) an elongated metal structure positioned within the channel of the non-conductive enclosure;

c) a composition contained within the non-conductive enclosure capable of forming a plasma, said plasma when formed having a skin depth within the enclosure such that electromagnetic waves penetrate the skin depth within the non-conductive enclosure and are primarily propagated directionally along the path, and wherein the plasma and the metal structure provide substantially the only media of electromagnetic wave propagation;

d) an energy source for energizing the composition to form the plasma; and e) an energy modifying medium to reconfigure the waveguide such that electromagnetic waves of various wavelengths may be propagated directionally along the path.

4. The reconfigurable coaxial electromagnetic waveguide of claim 3 wherein the metal structure is a metal wire or shaft.

5. A reconfigurable coaxial electromagnetic waveguide comprising:

a) an elongated continuous non-conductive enclosure defining a propagation path for directional electromagnetic wave propagation;

b) an elongated metal structure of essentially common length with the non-conductive enclosure and positioned substantially coaxially in relation to the non-conductive enclosure, wherein the metal structure is positioned within the channel of the of the non-conductive enclosure;

c) a composition contained within the non-conductive enclosure capable of forming a plasma, said plasma having a skin depth along a surface of the enclosure such that the electromagnetic waves penetrate the skin depth within the enclosure and are primarily propagated directionally along the path;

d) an energy source to form the plasma; and e) an energy modifying medium to reconfigure the waveguide such that electromagnetic waves of various wavelengths may be propagated directionally along the path.

6. The reconfigurable coaxial electromagnetic waveguide of claim 5 where the non-conductive enclosure is positioned within the channel of the of the metal structure.

7. A plasma electromagnetic waveguide comprising:

a) an elongated non-conductive enclosure defining a propagation path for directional electromagnetic wave propagation, wherein the enclosure further comprises a first open end and a second open end, said first open end and said second open end being connected by a channel, said channel being configured along the direction of wave propagation such that the electromagnetic waves travel within the channel;

b) a composition contained within the enclosure capable of forming a plasma, said plasma when formed having a skin depth along a surface within the enclosure such that the electromagnetic waves penetrate the skin depth and are primarily propagated directionally along the path, and wherein said plasma provides substantially a sole medium of the electromagnetic wave propagation; and c) an energy source for energizing the composition to form the plasma.

8. A plasma electromagnetic waveguide comprising:

a) an elongated non-conductive enclosure defining a propagation path for directional electromagnetic wave propagation;

b) a composition contained within the enclosure capable of forming a plasma, said plasma when formed having a skin depth along a surface within the enclosure such that the electromagnetic waves penetrate the skin depth and are primarily propagated directionally along the path, and wherein said plasma provides substantially a sole medium of the electromagnetic wave propagation; and c) an energy source for energizing the composition to form the plasma, wherein the energy source comprises high frequency signal.

9. A plasma electromagnetic waveguide comprising:

a) an elongated non-conductive enclosure defining a propagation path for directional electromagnetic wave propagation, wherein the enclosure comprises a plurality of individual chambers;

b) a composition contained within the enclosure capable of forming a plasma, said plasma when formed having a skin depth along a surface within the enclosure such that the electromagnetic waves penetrate the skin depth and are primarily propagated directionally along the path, and wherein said plasma provides substantially a sole medium of the electromagnetic wave propagation; and c) an energy source for energizing the composition to form the plasma.

10. A plasma electromagnetic waveguide comprising:

a) an elongated non-conductive enclosure defining a propagation path for directional electromagnetic wave propagation;

b) a composition contained within the enclosure capable of forming a plasma, said plasma when formed having a skin depth along a surface within the enclosure such that the electromagnetic waves penetrate the skin depth and are primarily propagated directionally along the path, and wherein said plasma provides substantially a sole medium of the electromagnetic wave propagation;

c) an energy source for energizing the composition to form the plasma; and d) an energy modifying medium to reconfigure the waveguide such that electromagnetic waves of various wavelengths may be propagated directionally along the path, wherein the energy modifying medium is configured to alter the skin depth of the plasma.

11. The plasma electromagnetic waveguide of claim 10 wherein the energy source comprises a pair of electrodes in electromagnetic contact with the composition.

12. The plasma electromagnetic waveguide of claim 11 wherein the pair of electrodes are an anode and a cathode positioned at opposite ends of the path.

13. The plasma electromagnetic waveguide of claim 10 wherein the energy source is selected from the group consisting of fiber optics, lasers, and electromagnetic couplers electromagnetically coupled to the composition.

14. The plasma electromagnetic waveguide of claim 10 wherein the energy modifying medium alters the density of the plasma.

15. The plasma electromagnetic waveguide of claim 10 wherein said enclosure is flexible along an axis perpendicular to the path and the energy modifying medium alters the plasma pressure within the flexible enclosure causing deformation of the enclosure.

16. The plasma electromagnetic waveguide of claim 10 wherein the waveguide further comprises a discontinuity in the waveguide such that said electromagnetic waves may be radiated.

17. The plasma electromagnetic waveguide of claim 16 wherein the discontinuity is provided by a structural discontinuity of the non-conductive enclosure.

18. The plasma electromagnetic waveguide of claim 16 wherein the discontinuity is created by a change in impedance along the path.

19. The plasma electromagnetic waveguide of claim 16 wherein the discontinuity is created by a change in skin depth.

20. The plasma electromagnetic waveguide of claim 10 wherein the composition is a gas selected from the group consisting of neon, xenon, argon, krypton, hydrogen, helium, mercury vapor, and combinations thereof.

21. The plasma electromagnetic waveguide of claim 10 wherein said enclosure is flexible along directions perpendicular to the path.

22. The plasma electromagnetic waveguide of claim 10 further comprising a signal generator in electrical contact with the plasma for generating electromagnetic waves to be propagated along the path.

23. The plasma electromagnetic waveguide of claim 22 further comprising a signal receiver in electrical contact with the plasma for receiving the electromagnetic waves generated by the signal generator and propagated along the path.

24. The plasma electromagnetic waveguide of claim 23 the electromagnetic waves produced by the signal generator also act as the energy source used to generate the plasma.

25. The plasma electromagnetic waveguide of claim 24 wherein said enclosure further comprises a first open end and a second open end, said first open end and said second open end being connected by a channel, said channel being configured along the direction of wave propagation such that the electromagnetic waves travel within the channel.

26. The plasma electromagnetic waveguide of claim 23 wherein the signal generator and the signal receiver are positioned at opposite ends of the enclosure along the direction of electromagnetic wave propagation.

27. A plasma coaxial electromagnetic waveguide comprising:

a) a first elongated non-conductive enclosure defining a propagation path for directional electromagnetic wave propagation, said first enclosure further comprising a first open end and a second open end, said first open end and said second open end being connected by a channel, said channel being oriented along the direction of wave propagation;

b) a second elongated non-conductive enclosure positioned within the channel of the first enclosure;

c) a first composition contained within the first enclosure capable of forming a first plasma, said first plasma when formed having a skin depth along a surface of the first enclosure;

d) a second composition contained within the second enclosure capable of forming a second plasma, said second plasma when formed having a skin depth along a surface of the second enclosure such that the electromagnetic waves penetrate the skin depth within the first enclosure and second enclosure and are primarily propagated directionally along the path; and e) at least one energy source for energizing the first composition and the second composition to form the respective first plasma and second plasma.

28. The plasma coaxial electromagnetic waveguide of claim 27 further comprising a signal receiver in electrical contact with at least one of the first and second plasma for receiving the electromagnetic waves generated by the signal generator and propagated along the path.

29. The plasma coaxial electromagnetic waveguide of claim 28 wherein the energy modifying medium alters the skin depth of at least one of the first and second plasma.

30. The plasma coaxial electromagnetic waveguide of claim 28 wherein the energy modifying medium alters the density of at least one of the first and the second plasma.

31. The plasma coaxial electromagnetic waveguide of claim 28 wherein the energy modifying medium alters the plasma pressure within at least one of the first enclosure and the second enclosure, said first and second enclosures being flexible in a directions perpendicular to the path, and wherein said plasma pressure causes a deformation of the enclosure.

32. The plasma coaxial electromagnetic waveguide of claim 27 wherein a cross-section of the first enclosure is annular in shape.

33. The plasma coaxial electromagnetic waveguide of claim 32 wherein a cross-section of the second enclosure is cylindrically shaped.

34. The plasma coaxial electromagnetic waveguide of claim 27 wherein a cross-section of the first enclosure is rectangular in shape.

35. The plasma coaxial electromagnetic waveguide of claim 34 wherein a cross-section of the second enclosure is rectangular in shape.

36. The plasma coaxial electromagnetic waveguide of claim 27 wherein said first enclosure is flexible along an axis perpendicular to the path.

37. The plasma coaxial electromagnetic waveguide of claim 27 wherein said second enclosure is flexible along an axis perpendicular to the path.

38. The plasma coaxial electromagnetic waveguide of claim 27 wherein said first enclosure is flexible along directions perpendicular to the path.

39. The plasma coaxial electromagnetic waveguide of claim 27 wherein said second enclosure is flexible along directions perpendicular to the path.

40. The plasma coaxial electromagnetic waveguide of claim 39 wherein the pair of electrodes are an anode and a cathode positioned at opposite ends of the path.

41. The plasma coaxial electromagnetic waveguide of claim 27 wherein the energy source is selected from the group consisting of fiber optics, lasers, and electromagnetic couplers electromagnetically coupled to the composition.

42. The plasma coaxial electromagnetic waveguide of claim 27 wherein the energy source comprises high frequency radiation.

43. The plasma coaxial electromagnetic waveguide of claim 27 wherein the energy modifying medium alters the skin depth of at least one of the first and second plasma.

44. The plasma coaxial electromagnetic waveguide of claim 27 wherein the energy modifying medium alters the density of at least one of the first and the second plasma.

45. The plasma coaxial electromagnetic waveguide of claim 28 wherein the signal generator and the signal receiver are positioned at opposite ends of the enclosure along the direction of electromagnetic wave propagation.

46. The plasma coaxial electromagnetic waveguide of claim 27 wherein the waveguide further comprises a discontinuity in the waveguide such that said electromagnetic waves may be radiated.

47. The plasma coaxial electromagnetic waveguide of claim 32 wherein said first enclosure is concentrically positioned in relation to the second enclosure.

48. The plasma coaxial electromagnetic waveguide of claim 46 wherein the discontinuity is created by a change in impedance.

49. The plasma coaxial electromagnetic waveguide of claim 48 wherein the discontinuity is provided by a structural discontinuity of at least one of the first non-conductive enclosure and the second non-conductive enclosure.

50. The plasma coaxial electromagnetic waveguide of claim 48 wherein the discontinuity is created by a change in impedance along the propagation path.

51. A reconfigurable coaxial electromagnetic waveguide comprising:

a) an elongated non-conductive enclosure defining a propagation path for directional electromagnetic wave propagation;

b) an elongated metal structure positioned coaxially in relation to the non-conductive enclosure;

c) a composition contained within the non-conductive enclosure capable of forming a plasma, said plasma having a skin depth along a surface of the enclosure such that the electromagnetic waves penetrate the skin depth within the enclosure and are primarily propagated directionally along the path;

d) an energy source to form the plasma; and e) an energy modifying medium to reconfigure the waveguide such that electromagnetic waves of various wavelengths may be propagated directionally along the path.

* * * * *